United States Patent [19]

Gijrath et al.

[11] 4,387,321

[45] Jun. 7, 1983

[54] COLOR DISPLAY TUBE AND SUSPENSION MEANS FOR COLOR SELECTION ELECTRODE

[75] Inventors: Johannes H. N. Gijrath; Albertus A. M. Van Liempd; Hendrik S. A. Versteegen; Josephus J. van der Geer; Henricus J. M. van der Avoort, all of Eindhoven, Netherlands

[73] Assignee: U.S. Philips Corporation, New York, N.Y.

[21] Appl. No.: 198,898

[22] Filed: Oct. 20, 1980

[30] Foreign Application Priority Data

Jul. 21, 1980 [NL] Netherlands ..... 8004173

[51] Int. Cl.[3] ..... H01J 29/07

[52] U.S. Cl. ..... 313/406

[58] Field of Search ..... 313/406

[56] References Cited

U.S. PATENT DOCUMENTS

| | | | |
|---|---|---|---|
| 3,334,259 | 8/1967 | Shrader | 313/406 |
| 3,487,251 | 12/1969 | Barten et al. | 313/406 |
| 4,065,693 | 12/1977 | Gijrath | 313/406 |
| 4,300,071 | 11/1981 | Dougherty et al. | 313/406 X |

*Primary Examiner*—Palmer C. Demeo

*Attorney, Agent, or Firm*—Robert J. Kraus

[57] ABSTRACT

A color selection electrode (7) is suspended from the corners of the upright edge (3) of a display window (2) by means of resilient elements (25) which extend substantially perpendicularly to the electron beams deflected towards the corners. The resilient elements (25) have apertures (28) with which the resilient elements (25) are placed on mandrils (31). The mandrils (31) are embedded in the corners of the upright edge (3) of the display window (2) perpendicularly to the planes of the resilient elements (25). A screening cap for screening the electron beams from the earth's magnetic field is connected on the mandrils (31) in such manner that the screening cap exerts no pressure on the resilient elements (25).

10 Claims, 8 Drawing Figures

COLOR DISPLAY TUBE AND SUSPENSION MEANS FOR COLOR SELECTION ELECTRODE

BACKGROUND OF THE INVENTION

The invention relates to a colour display tube comprising an envelope having a substantially rectangular display window provided with an upright edge and a substantially rectangular colour selection electrode having a large number of apertures. The colour selection electrode is suspended in the corners of the display window with the aid of suspension means comprising flat resilient elements connected to the colour selection electrode. Each flat resilient element is substantially perpendicular to the electron beams deflected towards the respective corner of the display window.

Such a colour display tube is disclosed in U.S. Pat. No. 3,986,071. In this tube, two metal pins are sealed in each corner of the upright edge of the display window, which pins extend in a direction perpendicular to the tube axis. Clamping springs are connected to the ends of the flat resilient elements remote from the colour selection electrode. The clamping springs have two notches. The colour selection electrode is suspended in the display window by sliding the clamping springs with the notches over the pins, the notches engaging the pins. In order to prevent the clamping springs from sliding along the pins during shocks or vibrations of the tube, a large clamping pressure of the clamping springs is required. As a result of this large clamping pressure, which is transferred to the glass by the pins, stresses occur in the glass. This increases the possibility of fracture in the usual temperature treatments to which the display tubes are subjected during manufacture. Moreover, in such a tube poor positioning reproducibility is obtained when the colour selection electrode is repeatedly mounted in and removed from the display window, because the clamping springs do not always assume the same position on the pins. Positioning reproducibility is to be understood to mean herein the extent to which the colour selection electrode assumes the same position during repeated removal and mounting which is necessary during the photographic provision of the display screen on the display window.

SUMMARY OF THE INVENTION

It is an object of the invention to provide a suspension of a colour selection electrode in a colour display tube in which the possibility of fracture of the tube during the manufacturing process is considerably reduced.

Another object of the invention is to provide a suspension of a colour selection electrode in a colour display tube, in which good positioning reproducibility of the colour selection electrode is obtained.

Still another object of the invention is to provide a suspension of a colour selection electrode in a colour display tube in which the colour selection electrode resists movement during shocks and vibrations of the tube.

Yet another object of the invention is to provide a conical internal screening cap which is adapted to the suspension of the colour selection electrode.

According to the invention, a colour display tube of a kind mentioned in the opening paragraph is characterized in that the end of each flat resilient element remote from the colour selection electrode has an aperture, and that a pin is sealed in each corner of the upright edge of the display window. The pin forms an angle with the upright edge of the display window such that the pin extends substantially perpendicularly to the plane of the respective flat resilient element. The pin is provided at its free end with a conical portion which protrudes through the aperture in the flat resilient element. Each flat resilient element is substantially perpendicular to the electron beams deflected towards the respective corner. As a result of the resilience and the positions of the flat resilient elements, the colour selection electrode with moves towards the display window when the temperature increases. In fact, at higher temperatures, a smaller distance is necessary between the colour selection electrode and the display window to maintain colour purity picture. The colour selection electrode is suspended in the display window by placing the flat resilient elements with their apertures on the conical portions of the pins. Since each pin is oriented with its conical portion perpendicular to the plane of the flat resilient element, the conical portion always protrudes through the aperture in the flat resilient element to the same extent. In addition, as a result of this position of the pins, the colour selection electrode can be simply mounted and removed. The flat resilient elements exert only a small pressure on the sealed pins, so that the occurrence of stresses causing fracture of the display tube is prevented.

It is to be noted that a colour display tube is known from Netherlands Patent Application No. 6610027, corresponding to U.S. Pat. No. 3,330,980, which comprises strip-shaped suspension members permitting a displacement of the colour selection electrode towards the display window when the colour selection electrode expands. The strip-shaped suspension members comprise an aperture with which the suspension members are placed on a mandril embedded in the upright edge of the display window. In this known tube, however, the colour selection electrode is suspended in the centres of the rectangular sides and not in the corners of the colour selection electrode. Moreover in order to obtain a good resistance to shocks in such a tube it is necessary for the stripshaped suspension members to exert a large clamping pressure on the mandrils. In colour display tubes in which the colour selection electrode does not have a rigid carrier frame, as is the case in particular in display tubes according to the invention, this leads to deformations of the colour selection electrode in the usual temperature treatments to which the tubes are subjected during the manufacture.

In a colour display tube in accordance with the invention, the flat resilient elements engage the pins with a small pressure only. In order to prevent the flat resilient elements from working loose from the pins in the case of shocks, according to a further embodiment the conical portions of the pins are secured to the edges of the apertures in the flat resilient elements by means such as glass enamel or cement or by laser welds or other contactless welds.

Another embodiment in which working loose of the flat resilient elements is prevented is characterized in that the pin comprises a mandril at its free end, which mandril is provided with the conical portion, and that a plate is provided on the conical portion of the mandril. The plate has an aperture which is smaller than the aperture in the flat resilient element, and the plate is clamped on the conical portion by means of a clamping member which engages both the plate and the portion of the mandril on the opposite side of the flat resilient element. Since the aperture in the plate is smaller than the aperture in the flat resilient element, the plate is spaced from the flat resilient element. In the case of shocks of the display tube, the plate limits movement of the colour selection electrode. The clamping member which presses the plate onto the conical portion exerts no pressure on the flat resilient element, thus protecting the flat resilient element against deformation in the case of shocks.

A further embodiment is characterized in that the aperture in the flat resilient element is a triangular aperture. As a result of this the conical portion of the pin engages the walls of the apertures in the flat resilient element in a reproducible manner.

Still another embodiment is characterized in that at least one flat resilient element comprises a slot-like aperture, which slot-like aperture is partly covered by a plate movably to the flat resilient element and having a triangular aperture. The position of the triangular aperture with respect to the flat resilient element is determined by the position of the respective pin. In principle, three flat resilient elements may be provided with a triangular aperture and be placed on the pins. As a result of this the position of the fourth flat resilient element is fixed. In order to adapt the aperture in the fourth flat resilient element to the position of the fourth pin, the fourth flat resilient element has a slot-like aperture. The plate with the triangular aperture is now connected to the fourth flat resilient element in such manner that the position of the aperture corresponds to the position of the fourth pin. Preferably, three or four flat resilient elements have a slot-like aperture to which a plate having a triangular aperture is connected. As a result of this, diagonally opposite flat resilient elements engage the pins with the same pressure.

Yet another embodiment is characterized in that the tube has a conical internal screening cap which is provided in each corner with a suspension element comprising a portion extending substantially parallel to the plane of the flat resilient element. This portion has an aperture through which the free end of a pin extends. In a display tube an internal screening cap is usually used to screen the electron beams from the earth's magnetic field. The screening cap is secured to the pins so as to be mechanically free from the colour selection electrode. As a result of this, in the case of shocks and vibrations of the tube, the screening cap does not deform the flat resilient elements of the colour selection electrode.

An embodiment is characterized in that the free ends of the pins have a second conical portion with greater eccentricity than the first conical portion and which second conical portion extends partly through the aperture in the suspension element of the screening cap. By providing the pin with a second conical portion, a suspension place for the screening cap is obtained in a simple manner. Since the second conical portion on which the screening cap bears has a greater eccentricity than the first conical portion on which the colour selection electrode bears, the screening cap is secured so as to be free from the colour selection electrode. Since the apertures in the suspension elements of the screening cap fall partly over the second conical portion of mandrils, the apertures in the suspension elements need not be particularly accurate.

A further embodiment is characterized in that two diagonally opposite suspension elements of the screening cap comprise circular apertures and that the two other suspension elements comprise slot-like apertures. When the screening cap with the two suspension elements comprising the circular apertures is placed on the second conical portion of two diagonally opposite mandrils, the position of the apertures in the two other suspension elements is fixed. Because the position of the apertures should correspond to the position of the pins, the said apertures are constructed as slot-like apertures.

Still a further embodiment is characterized in that each suspension element of the screening cap is clamped onto the respective mandril by means of a clamping member which engages the suspension element and the end of the mandril on the embedded end of the pin. Herewith a simple connection of the screening cap is obtained in which the clamping member is not connected to a flat resilient element and thus cannot exert pressure on the flat resilient element. In this embodiment, the suspension element in each corner of the screening cap also limits movement of the respective flat resilient element and thus prevents working loose of the flat resilient elements from the pins.

According to another embodiment the mandrils are secured to the edges of the apertures in the suspension elements by means such as glass enamel, cement or welds.

BRIEF DESCRIPTION OF THE DRAWING

The invention will now be described in greater detail, by way of example, with reference to the accompanying drawing, of which

DESCRIPTION OF THE PREFERRED EMBODIMENTS

Figure 1:
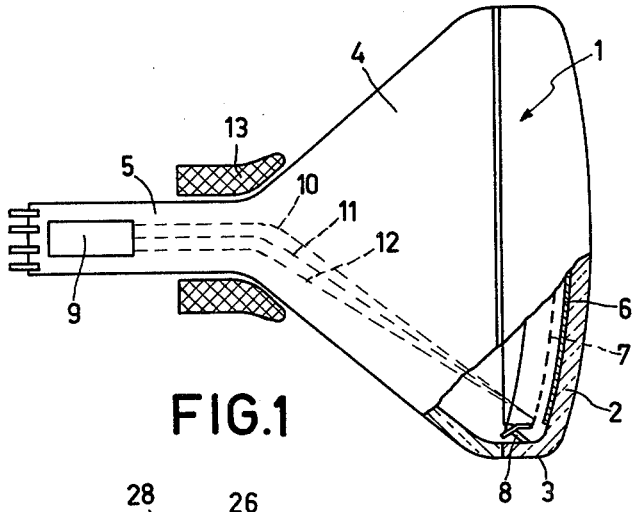
FIG. 1 is a partial sectional view of a colour display tube according to the invention.

The colour display tube shown in FIG. 1 is formed by a glass envelope 1 which has a substantially rectangular display window 2 which comprises an upright edge 3, a cone 4 and a neck 5. A pattern of phosphors 6 luminescing in the colours red, green and blue is provided on the display window 2. At a short distance from the display window 2 a colour selection electrode 7 having a large number of apertures is connected by means of suspensions 8 shown diagrammatically. An electron gun 9 for generating three electron beams 10, 11 and 12 is mounted in the neck 5 of the tube. These beams are deflected by means of a system of deflection coils 13 and intersect each other substantially at the area of the colour selection electrode 7 after which each of the electron beams impinges on one of the three phosphors provided on the display screen.

Figure 2:
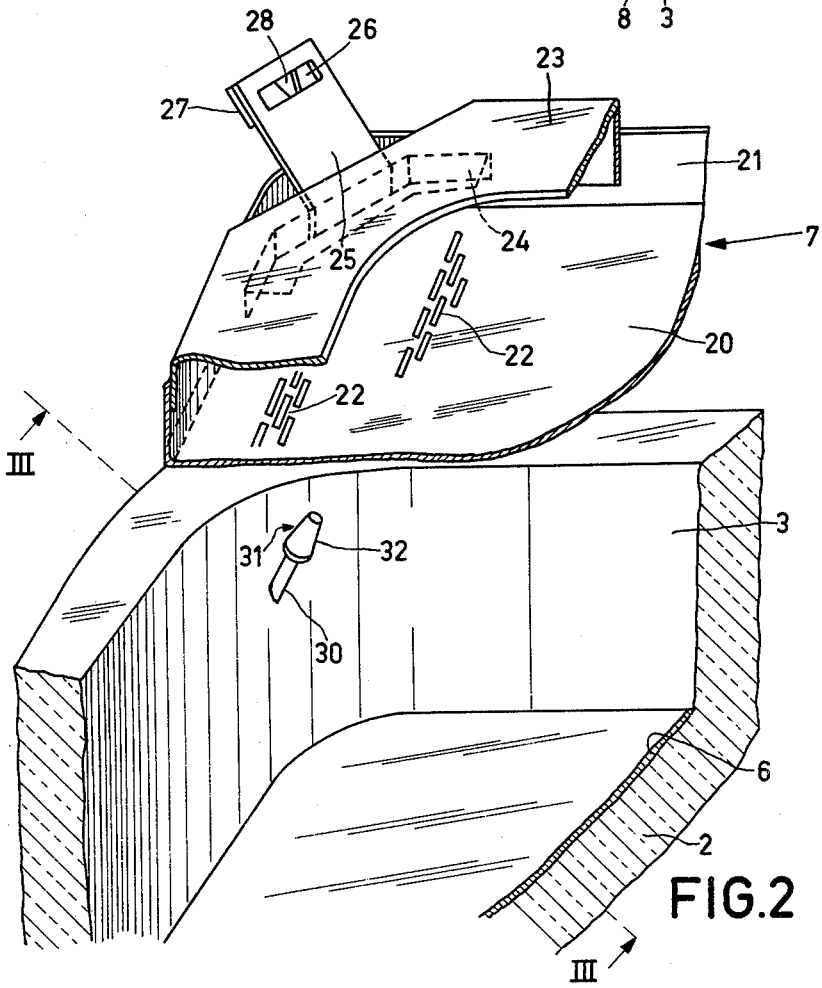
FIG. 2 is an exploded perspective view of the suspension of the colour selection electrode in a corner of the display window shown diagrammatically in FIG. 1.

FIG. 2 is an exploded perspective view of a corner of the display window. The colour selection electrode 7 is formed by a thin mask sheet 20 comprising a large number of apertures 22 and an upright edge 21. A mask ring 23 is connected to the upright edge 21 and also forms a diaphragm to prevent reflections of electrons at the upright edge 21. In order to avoid differences in expansion between the mask sheet 20 and the mask ring 23, both are manufactured from the same material and in approximately the same thickness. A supporting strip 24 is connected to the corner of the mask ring 23. A flat resilient element 25 is connected to supporting strip 24. The flat resilient element 25 makes such an angle with the longitudinal axis of the tube that it is substantially perpendicular to the electron beams deflected towards the corner of the display window.

A slot-like aperture 26 is provided at the free end of the resilient element 25. This aperture is partly covered by a plate 27 having a triangular aperture and connected to the resilient element 25. The function of the plate 27 will be described in greater detail hereinafter. A metal pin 30 is sealed in the corner of the upright edge 3 of the display window 2. The pin 30 forms such an angle with the upright edge 3 that the pin 3 is substantially at right angles to the plane of the resilient element 25. At its free end the pin 30 comprises a mandril 31 which has a conical portion 32. The colour selection electrode 7 is suspended in the display window by placing the resilient elements 25 with their apertures 28 on the conical portion 32 of the mandrils 31. The conical portion 32 engages the walls of the aperture 28 at three points.

The function of the plate 27 in manufacturing the display tube is as follows. The pins 30 are sealed in the corners of the upright edges 3. A mask ring 23 with flat resilient elements 25 already connected in the corners is then positioned in the display window 2. This is done by placing the slot-like apertures 26 of the flat resilient elements 25 on the mandrils 31 with the interposed plates 27 having the triangular apertures 28. The plates are then connected to the resilient elements 25 effecting accurate alignment of the apertures 28 with the mandrils 31. If the triangular apertures 28 were provided directly in the flat resilient elements 25, deformations of the colour selection electrode would occur because of differences in the positions of the apertures and the mandrils.

In principle a mask ring can be used which has only one flat resilient element 25 with slot-like aperture 26 and associated plate 27 with triangular aperture 28. During assembly of such a mask ring, two diagonally opposite flat resilient elements having triangular apertures are placed on the respective mandrils. By using the resilience of these elements, a triangular aperture in the third resilient element is placed on a mandril. As a result of this the position of the triangular aperture for the fourth flat resilient element is fixed. By means of the separate plate having a triangular aperture, the position of the triangular aperture for the fourth flat resilient element is adapted to the position of the fourth mandril.

In order to ensure that the two diagonally opposite flat resilient elements consistently engage the mandrils of the pins with the same clamping pressure, the triangular apertures are provided on the flat resilient elements having the slot-like aperture by attaching thereto plates having triangular apertures. In the embodiment shown all four flat resilient elements comprise a slot-like aperture and a plate having a triangular aperture, which is done for technical manufacturing reasons.

After placing the mask ring 23 with the flat resilient elements 25 on the mandrils 31 in the above-described manner, the mask sheet 20 is laid in the display window with the interposition of a spacer jig, after which the mask ring 23 is welded to the upright edge 21.

Figure 3:
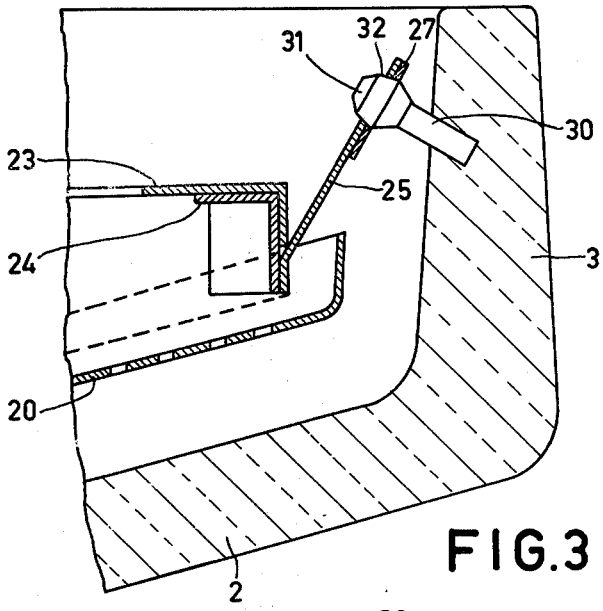
FIG. 3 is a sectional view taken on the line III—III of FIG. 2, FIGS. 4*a* and 4*b* show an embodiment of the suspension of the colour selection electrode.

FIG. 3 is a sectional view taken on the line III—III of FIG. 2 in which the colour selection electrode is shown in the assembled condition. The flat resilient element 25 is connected to the colour selection electrode 7 at such an angle that it is substantially perpendicular to the electron beams deflected towards the corner of the display window. As a result of the resilience of the resilient elements 25 the colour selection electrode 7 will move in a direction towards the display window 2 when the temperature rises. At a higher temperature of the colour selection electrode 7 a smaller distance between the colour selection electrode and the display window 2 is necessary due to the expansion of the electrode, to maintain a good colour purity. Because the colour selection electrode 7 is suspended in the corners of the display window 2, and such suspension is rotationally symmetrical with respect to the centre of the colour selection electrode, rotation of the colour selection electrode will not occur in the case of thermal expansion, so fading of the picture does not occur.

The flat resilient elements 25 engage the mandrils 31 at a very small pressure. In order to prevent shocks and vibrations from causing the flat resilient elements 25 to slide off of the mandrils 31, the conical portions 32 may be secured to the edges of the apertures 28. This can be done, for example, by means of a glass enamel, a cement or a laser weld or other contactless weld. Sliding off of the resilient elements can also be prevented by means of a clamping member, which will be described with reference to FIGS. 4*a* and 4*b*.

Figure 4A:
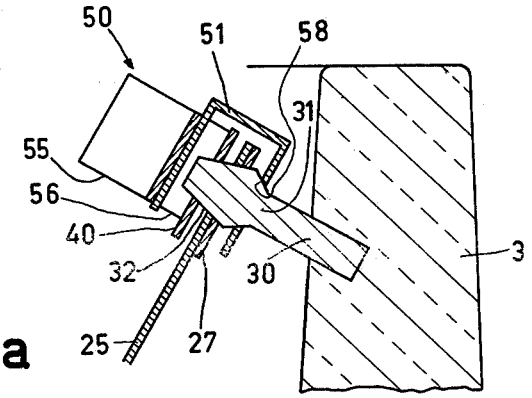
Figure 4B:
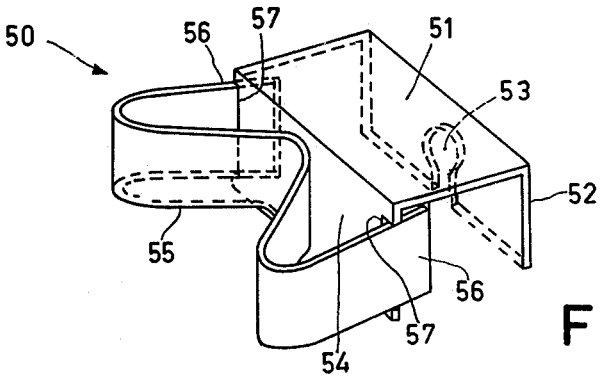

FIG. 4*a* is a sectional view of a part of the corner of the display window along a diagonal of the display window. The same components are referred to by the same reference numerals as in FIGS. 2 and 3. A plate 40 having an aperture smaller than the aperture in the flat resilient element 25 is provided on the conical portion 32 of the mandril so that the plate 40 is located some distance from the flat resilient element 25. The length of the conical portion 32 of the mandril 31 is restricted since the colour selection electrode has to be disassembled and assembled again in the display window. In order to prevent the plate from engaging the flat resilient element 25, the aperture in the plate 40 should therefore accurately satisfy the prescribed dimensions. The plate 40 is clamped on the conical portion 32 by means of a clamping member 50 which is shown in a perspective view in FIG. 4*b*. The clamping member 50 is formed by a U-shaped profiled member 51. A slot-like aperture 53 is provided in the limb 52 of the member 51. A bent resilient strip 55 is connected to the other limb 54. By squeezing the strip 55, the two ends 56 can be moved in the limb 54 along notches 57. The plate 40 is clamped on the conical portion 32 by the ends 56 of the strip 55. The slot-like aperture 53 engages the rising portion 58 of the mandril 31. The movement of the flat resilient element 25 in the case of shocks of the display tube is limited by the plate 40 with the clamping member 50, without the plate 40 and the clamping member 50 exerting pressure on the flat resilient element 25.

Figure 5A:
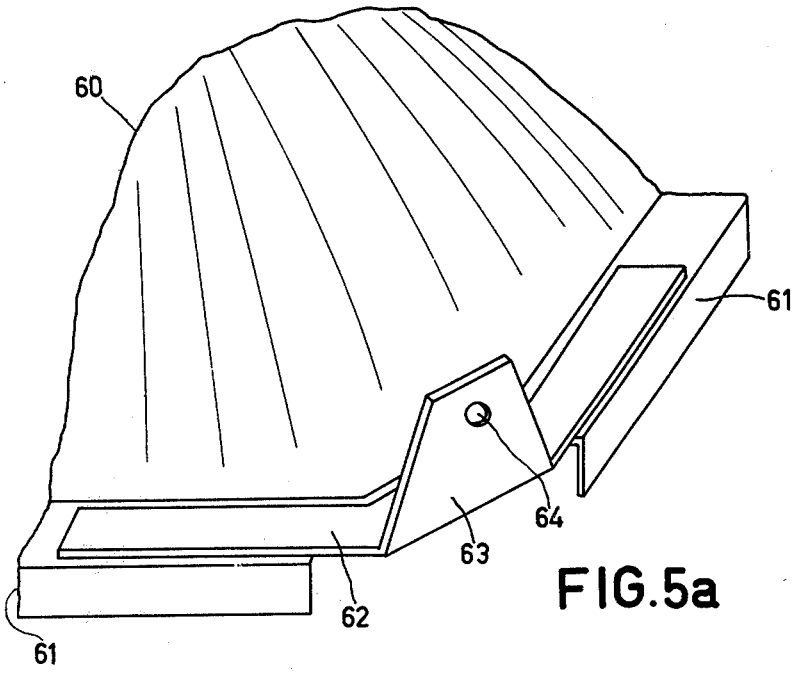
FIG. 5*a* is a perspective view of a corner of the internal conical screening cap.

FIG. 5*a* is a perspective view of a corner of a conical internal screening cap 60 which is often used in a display tube to screen the electron beams from the earth's magnetic field. The screening cap 60 comprises, on its rectangular sides, a flange 61 which in the assembled condition partly overlaps the diaphragm of the colour selection electrode. A suspension element 62 is connected in each corner of the screening cap 60. The suspension element 62 comprises a bent-over portion 63 which extends substantially parallel to the flat resilient element with which the colour selection electrode is attached to the corner of the display window. The bent-over portion 63 has an aperture 64 for the suspension of the screening cap 60 in the display window.

Figure 5B:
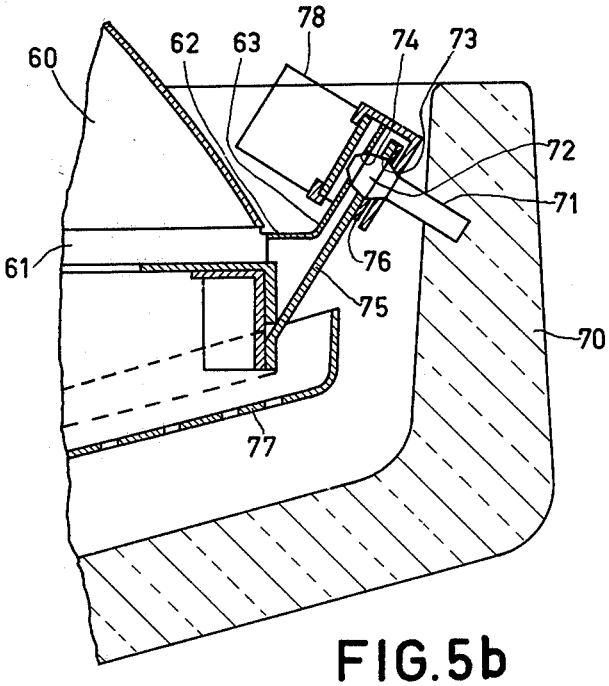
FIG. 5*b* shows the suspension of the screening cap in the tube.

FIG. 5*b* is a sectional view of a corner of the display window along a diagonal with the screening cap in the assembled condition. A pin 71 is again sealed in the corner of the upright edge 70 of the display window. The pin 71 has a mandril 72 having a first conical portion 73 and a second conical portion 74. The flat resilient elements 75 and plates 76 are mounted on the first conical portion 72 in the manner already described, with which the colour selection electrode 77 is suspended. The suspension elements 63 of the screening cap 60 with apertures 64 are placed on the second conical portion 74. In the assembled condition the screening cap 60 may not exert pressure on the flat resilient elements 75 and in the case of shocks may not slide past the mandril against the flat resilient elements 75. Moreover, the length of the mandril 72 is restricted in connection with the space required for the disassembly and assembly of the colour selection electrode 77. It is also desireable that the apertures 64 in the suspension elements 62 of the screening cap need not be manufactured with great accuracy. Two diagonally opposite suspension elements 62 have circular apertures 64. The two other suspension elements 62 have slot-like apertures 64 to adapt the apertures to the position of the associated mandrils. By providing the mandrils 72 with a second conical portion 74 which has a greater eccentricity than the first conical portion 73, the above conditions are satisfied in a simple manner. Suspending the screening cap 60 is also facilitated due to the large eccentricity of the second conical portion 74, since the apertures 64 centre themselves in the suspension elements. Working loose of the screening cap 60 in the case of shocks and vibrations of the tube is prevented by a clamping member 78 which clamps the suspension elements 63 on the second conical portions 74 without exerting pressure on the flat resilient elements 75. The clamping member 78 is similar to the clamping member shown in FIG. 4*b*. It will be obvious that the invention is not restricted to the clamping member shown, but that a variety of clamping members may be used. As a result of the connection of the screening cap 60, the flat resilient elements 75 are prevented from sliding off the mandrils 72 in the case of shocks and vibrations of the tube.

Figure 5C:
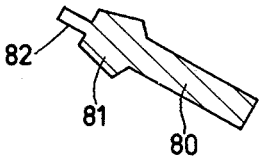
FIG. 5*c* shows another embodiment of a pin for the suspension of the screening cap.

FIG. 5*c* shows another embodiment of a pin having means to suspend the screening cap. The pin 80 again has a conical portion 81 for suspending the colour selection electrode. A reduced diameter pin 82 is provided on the conical portion 31. The suspension element is placed with its aperture on the pin 81, the suspension element engaging the conical portion 81.

Working loose of the screening cap from the pins can be prevented by means other than a clamping member, such as by securing the edges of the apertures in the suspension elements to the pins. This may be done, for example, by means of glass enamel, cement or laser welds or other contactless welds.

What is claimed is:

1. A color display tube comprising an envelope having a rectangular display window with an upright edge, a rectangular color selection electrode, an electron beam source, and means for removably attaching the color selection electrode to the window;

said means comprising a plurality of pins each having one end attached to a corner of the upright edge, and a plurality of flat resilient elements each having one end attached to a corner of the color selection electrode;

each of said pins forming an acute angle with the respective edge such that the free end is directed parallel to a path followed by the electron beam to the respective corner, and each of said flat resilient elements forming an angle with the color selection electrode such that the element extends perpendicularly to the direction of a respective one of the pins;

each of said pins having a conical portion at its free end, and each of said flat resilient elements having an aperture in its free end for receiving the conical portion of the respective pin to effect attachment of the color selection electrode to the window.

2. A color display tube as in claim 1, characterized in that the aperture in at least one of the flat resilient elements is triangular-shaped.

3. A color display tube as in claim 1 or 2, characterized in that the aperture in at least one of said flat resilient elements is slot-shaped, said aperture being partly covered by a plate having a triangular-shaped aperture.

4. A color display tube as in claim 1 or 2, characterized in that the conical portions of the pins are secured to the edges of the apertures where they make contact.

5. A color display tube as in claim 1 or 2, characterized in that each pin comprises a mandrel at its free end on which said conical portion is provided, said mandrel having a second conical portion spaced from the free end and having its apex in the direction of said upright edge, and further including a plate and a clamping member, said plate having an aperture which is smaller than the aperture in the respective flat resilient element, and said clamping member clamping the plate onto the end of the mandrel by engaging the plate and the second conical portion.

6. A color display tube as in claim 1 or 2, characterized in that the tube includes a conical internal screening cap having attached suspension elements each comprising a portion extending substantially parallel to a respective one of the flat resilient elements, said portion having an aperture for engaging the free end of a respective pin at a distance from the flat resilient element.

7. A color display tube as in claim 6, characterized in that the conical portion of each pin has surfaces of different eccentricity for engagement with the respective flat resilient element and suspension element.

8. A color display tube as in claim 6, characterized in that the apertures in two diagonally opposite suspension elements are circular, and the apertures in the other two suspension elements are slot-shaped.

9. A color display tube as in claim 6, characterized in that each pin includes a mandrel at its free end on which is provided said conical portion, said mandrel having a second conical portion spaced from the free end and having its apex in the direction of said upright edge, and further including a clamping member for clamping the suspension element onto the mandrel by engaging the suspension element and the second conical portion.

10. A color display tube as in claim 6, characterized in that the pins are secured to the edges of the apertures in the suspension element where they make contact.

* * * * *